US005785461A

United States Patent [19]

Lambert

[11] Patent Number: 5,785,461

[45] Date of Patent: Jul. 28, 1998

[54] WEDGE TENSIONING DEVICE

[76] Inventor: Gene F. Lambert, 2023 Cochran Rd., Maryville, Tenn. 37801

[21] Appl. No.: 588,127

[22] Filed: Jan. 18, 1996

[51] Int. Cl.[6] ..... B07B 1/49; B02C 17/08

[52] U.S. Cl. ..... 403/405.1; 209/403; 209/405; 241/207; 403/168; 403/374; 403/409.1; 160/378

[58] Field of Search ..... 209/401, 403, 209/405; 241/207; 403/167, 168, 374, 405.1, 409.1; 160/378

[56] References Cited

U.S. PATENT DOCUMENTS

| | | | |
|---|---|---|---|
| 1,083,283 | 1/1914 | Kelly | 241/207 |
| 1,234,020 | 7/1917 | Harp | 403/409.1 X |
| 3,092,573 | 6/1963 | Lambert et al. | 209/403 |
| 3,198,562 | 8/1965 | Smith | 403/374 X |
| 3,203,548 | 8/1965 | Roubal | 209/403 X |
| 3,307,699 | 3/1967 | Shira | 209/403 |
| 4,210,212 | 7/1980 | Jackson et al. | 403/409.1 X |
| 4,415,825 | 11/1983 | Dailey et al. | 403/405.1 X |
| 4,436,342 | 3/1984 | Nilson et al. | 403/409.1 X |
| 4,611,766 | 9/1986 | Seifert | 403/409.1 X |
| 4,735,712 | 4/1988 | Herren et al. | 209/401 X |
| 5,290,122 | 3/1994 | Hulme | 403/374 |
| 5,451,116 | 9/1995 | Czachor et al. | 403/405.1 X |

FOREIGN PATENT DOCUMENTS

| | | | |
|---|---|---|---|
| 2631255 | 11/1989 | France | 209/403 |
| 631195 | 11/1978 | U.S.S.R. | 241/207 |
| 796479 | 1/1981 | U.S.S.R. | 403/409 |
| 977006 | 11/1982 | U.S.S.R. | 241/207 |
| 1604014 | 12/1981 | United Kingdom | 403/409.1 |

*Primary Examiner*—Blair Johnson
*Assistant Examiner*—Andrea Chop

[57] ABSTRACT

A wedge tensioning device for securing screen material to a screening system having a T-bolt with a threaded shank for receiving a nut threadably engaged therewith for adjustment toward and away from the frame. A pair of opposing wedges each having an elongated aperture through each wedge is provided. The T-bolt is passed through the elongated aperture of each wedge and is positioned between the frame and the nut. A spacer having an aperture therethrough is positioned between the wedges. The screen may be readily removed from the screening apparatus by driving the smaller end of one of the two wedges away from the bolt shank and out from its position to thereby loosen the tension on the screen material and permit it removal and replacement. To tension the screen material, the large end of one of the two wedges may be driven toward the shank of the bolt.

4 Claims, 3 Drawing Sheets

WEDGE TENSIONING DEVICE

BACKGROUND OF THE INVENTION

This invention relates to a wedge tensioning device and more particularly to an improved device for securing a screen to the frame of a screening apparatus whereby the screen may be effectively supported and readily tensioned. It further relates to an improved device for securing the crusher adjustment cap to a crusher bowl apparatus and for securing the skirtboard rubber to a conveyor skirt board apparatus.

A primary object of this invention is to provide a tensioning device wherein a novel and improved tension wedging member and tension relief wedging member are interposed between an adjustable member and the supporting frame of the machine.

Various types of prior tensioning devices for screening apparatus, cone crusher apparatus and conveyor skirt board apparatus have been proposed. The problem of providing a suitable effective fastening and tensioning device for these is that the apparatuses are subject to considerable shaking and vibratory motion. It is necessary that the fastening and tensioning means maintain proper tension yet allow for replacement as parts wear or damage occurs. One primary objection to prior tensioning devices has been due to the fact that the fastening and tensioning mechanisms have been such as to render adjustments difficult and time consuming. Often only limited access is available to adjust the prior tensioning devices which makes it difficult to maintain proper adjustment.

Additionally, prior tensioning devices have not been particularly effective in preventing loosening by reason of the vibratory actions of the various apparatuses. This results in the necessity of frequent attention to maintain proper tension.

It is one object of this tensioning and fastening device to overcome certain disadvantages of prior devices intended for like purpose. This improved device may be manufactured at a relatively low cost.

It is another object of this invention to provide an improved fastening and tensioning device which is readily adjustable for maintaining proper tension.

It is further an object of this invention to provide an improved wedge holding and tensioning system which quickly and efficiently secures and tensions.

It is still another object of this invention to provide an improved device which may be quickly adopted to existing apparatuses and systems without expensive modification of existing equipment.

It is still another object of this invention to provide a system which can quickly apply or release tension by means of a unique system of dual wedges.

Still another object of this invention is to provide an improved fastening and tensioning device which does not disassemble when tension on the apparatus is relieved.

These and other objects and advantages of the invention will become apparent from the following detailed description.

SUMMARY OF THE INVENTION

In one embodiment of the invention, the tensioning device is in the nature of a T-bolt having a threaded shank for receiving a nut threadably engaged therewith for adjustment toward and away from the frame of an apparatus such a screening system to provide a predetermined spacing between the nut and said frame. A pair of opposing wedges each having an elongated aperture through each wedge is provided. The T-bolt is passed through the elongated aperture of each wedge and is positioned between the frame and the nut. A spacer having an aperture therethrough is positioned between the wedges. The screen may be readily removed from the screening apparatus by driving the smaller end of one of the two wedges away from the bolt shank and out from its position to thereby loosen the tension. Reinstallation of a new or repaired screen may be thereupon easily made. The large end of one of the two wedges may then be driven toward the shank of the bolt to fasten and tension the screen. If further adjustments are required from time to time in order to properly tension the screen, the nut may be readily adjusted along with the shank of the bolt to provide the correct spacing for receiving the pair of wedges. With this improved device, the screen is held securely at the proper tension regardless of the vibratory action of the apparatus. This invention also permits tensioning or releasing by selectively driving the tension wedge or release wedge. It will be readily understood by those skilled in the art that this invention permits tensioning or releasing by selectively striking the tension wedge or release wedge from the same direction.

BRIEF DESCRIPTION OF THE DRAWINGS

These and other features, aspects, and advantages of the present invention will become better understood with regard to the following description, appended claims, and accompanying drawings when:

DESCRIPTION OF THE PREFERRED EMBODIMENT

Figure 1:
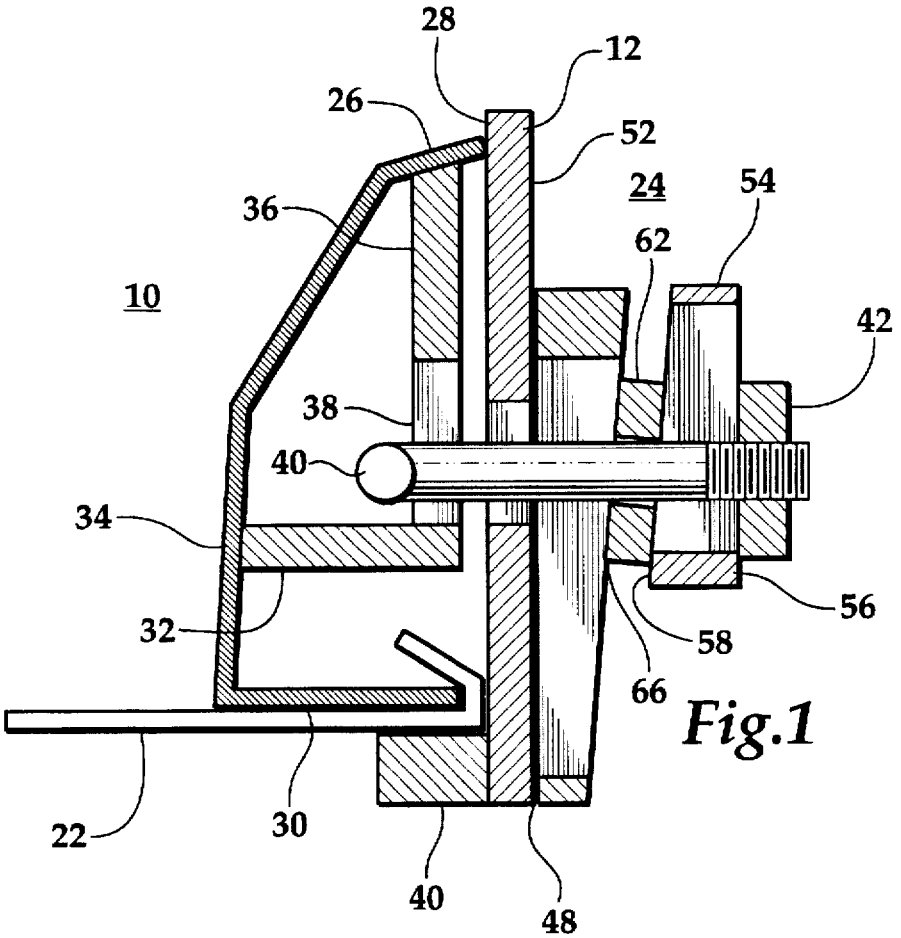
FIG. 1 is a cross sectional elevation of the device as used with a screening apparatus.
Figure 2:
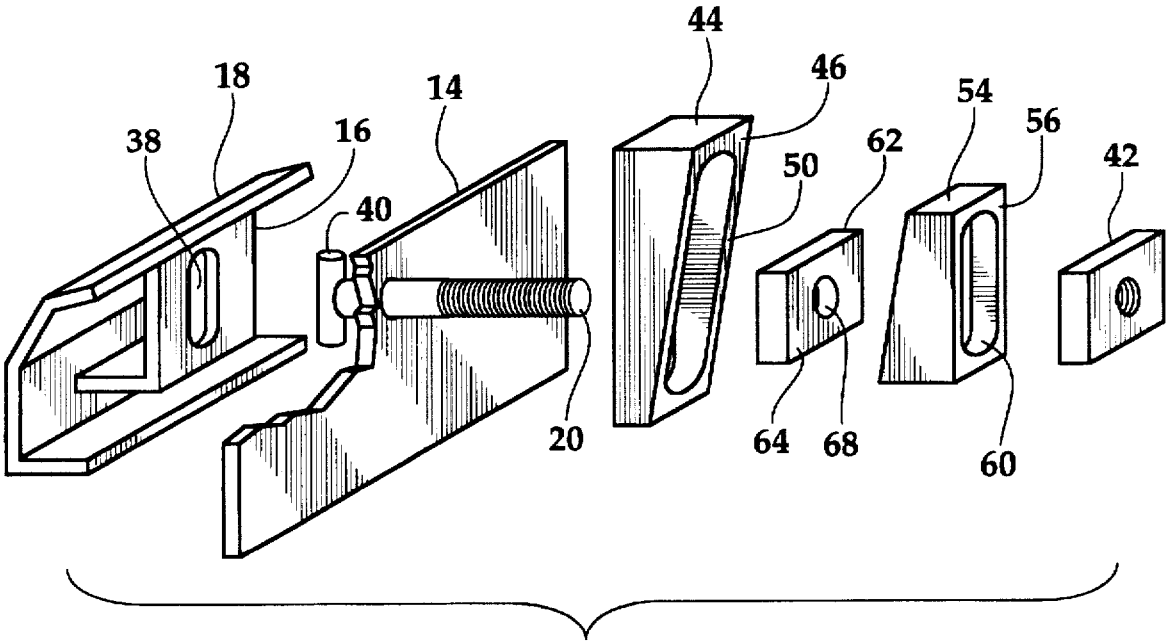
FIG. 2 is an exploded view of the device as used with a screening apparatus.

An overall view of the screen tensioning device as used with a screening apparatus is shown in FIG. 1.

FIG. 1 discloses a cross sectional view of a portion of a screening apparatus 10 comprised generally of a screen side or frame 12 provided with an opening 14 there through which an individual T-bolt 20 is inserted to secure screen T-bolt clip 16. The T-bolt clip 16 is secured generally to screen side rail 18. Screen cloth 22 is shown secured to side rail 12 and tensioned by wedge tensioning device 24. The screen cloth may be of different mesh and may require different tensioning dependent upon the nature of the screening process. It will be understood by those knowledgeable in the art that the number of screens in a box or frame will be dependent upon the nature of the screening desired and the specific disclosure of a single wedge tensioning device to illustrate the invention is for descriptive purposes only.

The longitudinally extending screen side rail 18 is formed of metal stamped, punched or extruded so as to have a channel shape as disclosed in FIG. 1 with upper flange 26 of each screen side rail 18 adapted to engage the interior surface of the adjacent frame side member 28. The lower flange 30 of the screen side rail 18 is adapted to engage and hold the hooked edge of screen 22. Another screen side rail similar to 18 is located on an opposing frame side member (not shown). Thus, screen 22 is held and tensioned between a pair of screen side rails 18.

Screen side rail 18 is provided with T-bolt clip 16. T-bolt clip 16 is L-shaped with lower leg 32 attached to screen side rail 18 at section 34. The upper leg 36 of T-bolt clip 16 is attached to upper flange 26 of screen side rail 18. The upper leg 36 of T-bolt clip 16 is provided with an elongated aperture 38.

Screen side rail 18 is secured to screen side or frame 12 by T-bolt 20 having a flange forming head 40 inserted through aperture 38 on T-bolt clip 16 and through aperture 14 of screen side or frame 12. The T-bolt 20 is secured to hold and tension screen 22 as hereinafter described.

Referring to FIG. 1, the relationship of the wedge tensioning device 24 to the screen side frames 12 is readily apparent, with screen 22 being shown and tensioned between screen side rails 18.

To prevent displacement and to provide positive positioning, screen 22 is held between lower flange 30 and longitudinally extending flange 40 secured along screen side or frame 12. Threaded nut member 42 is received on threaded T-bolt 20 and may be rotated to position the threaded nut toward or away from screen side 12.

A first wedge member 44 is provided with substantially flat inclined bearing surfaces 46 and 48. An elongated aperture 50 is provided through bearing surfaces 46 and 48. Bolt 20 is received through elongated aperture 50 such that bearing surface 48 bears against surface 52 of screen side 12.

A second wedge 54 is provided having substantially flat inclined bearing surfaces 56 and 58. Second wedge 54 is provided with an elongated aperture 60 through bearing surfaces 56 and 58. Bolt 20 is received through aperture 60. Nut 42 is threadably received on bolt 20 and bears against surface 56.

It will be recognized by those skilled in the art that surface 46 and surface 58 could bear against each other and provide selective tensioning to bolt 20 which is an object of this invention. In addition, a spacer 62 may be provided with substantially flat bearing surfaces 64 and 66. Spacer 62 has an aperture 68 through bearing surfaces 64 and 66. Spacer 62 is received onto bolt 20 through aperture 68 and positioned between first wedge 44 and second wedge 54. When secured, wedge surface 58 bears on spacer surface 64 and wedge surface 46 bears on spacer surface 66. It will be readily recognized by those skilled in the art that the device may be operated without spacer 62.

As wedge 44 is driven into position, inclined bearing surface 46 coacts with bearing surface 66 of spacer 62 and bolt 20 is urged in a direction outwardly away from screen side or frame 12 thus causing screen side rails 18 to pivot about upper flange 26 which maintains engagement with screen side member 28. This causes screen 22 to be tightened and tensioned as lower flange 30 of T-bolt clip 16 moves toward side member 28 carrying the edge of the screen 22 with it.

To remove screen 22 for repair or replacement, it is only necessary to drive wedge 54 out of engagement with thread nut member 42 and spacer 62, unlock the screen from flange 30 and insert another screen so as to engage the lower part of flange 30 of screen side rail 18. Wedge member 44 is again driven into position without any need to manipulate threaded nut member 42. If for some reason the dimensions of the screen should vary, or if the amount of tension required differs than that of the initial screen, threaded member 42 can be threaded toward or away from screen side or frame 12 as required.

Figure 3:
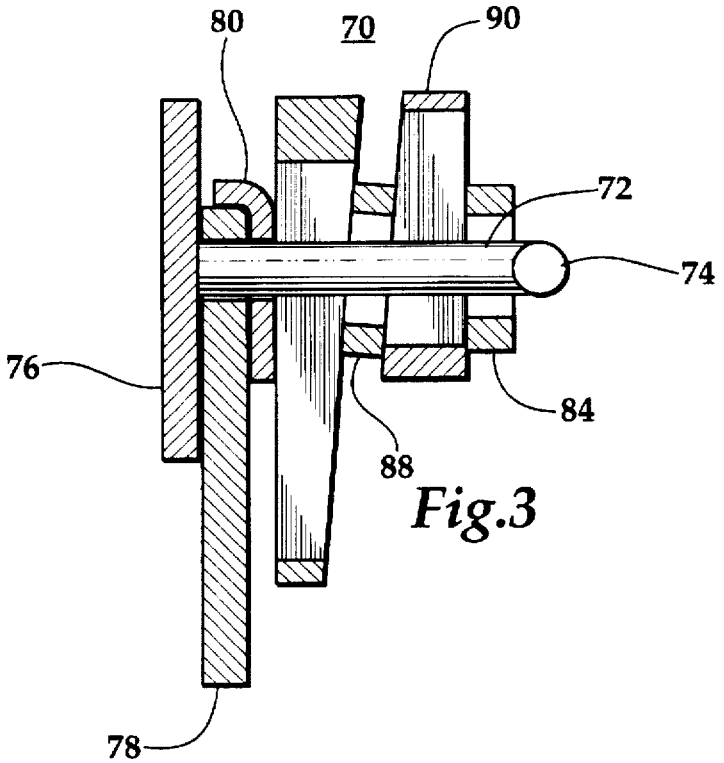
FIG. 3 is a cross sectional elevation of the device as used with a conveyor skirt board apparatus.
Figure 4:
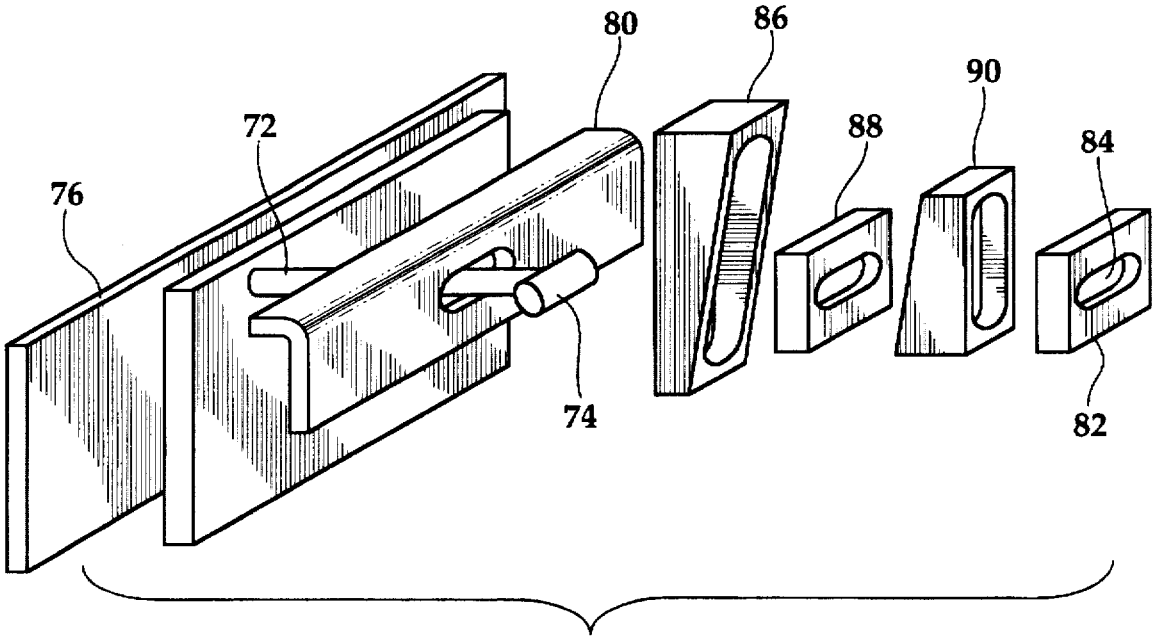
FIG. 4.is an exploded view of the device as used with a conveyor skirt board apparatus.

A slightly modified tensioning device 70 is shown in FIGS. 3 and 4 wherein a T-headed shank pin 72 is provided. One end of member 72 opposite head 74 is attached to skirt board 76. Shank member 72 passes through an aperture in skirt board rubber 78 and skirt board rubber clamp 80. In this embodiment, a retaining member 82 is provided which has an elongated aperture 84 which when in register with head 74 may be passed therethrough. Once head member 74 is passed through elongated aperture 84 toward skirt board 76, member 82 is rotated 90 degrees such that head 74 is seated against member 82 thus retaining two wedges and spacer. Tensioning is accomplished by driving wedge member 86 such that the inclined surfaces of wedge 86 coact with skirt board rubber clamp 80 and spacer 88 in a direction outwardly away from skirt board 76. To release, wedge 90 is driven such that the coactive surfaces of spacer 88 and retaining member 82 release the tension drawing skirt board 76 outwardly.

Figure 5:
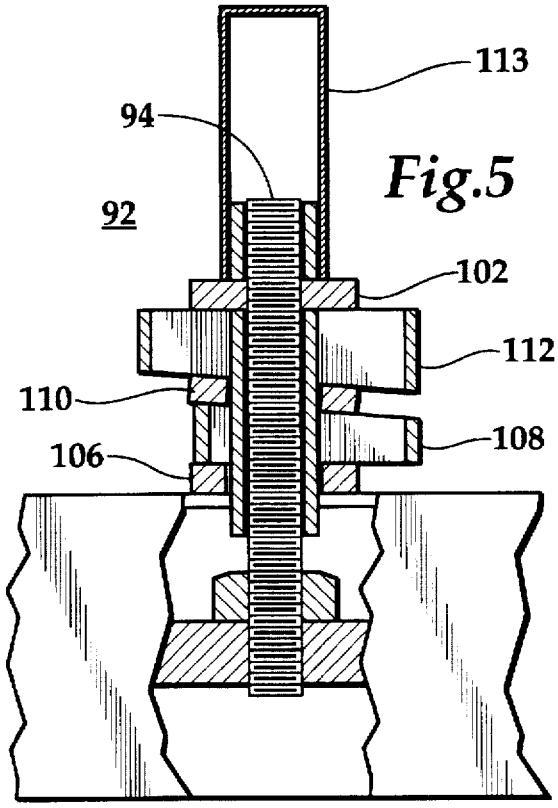
FIG. 5 is a cross sectional elevation of the device as used with a cone crusher apparatus.
Figure 6:
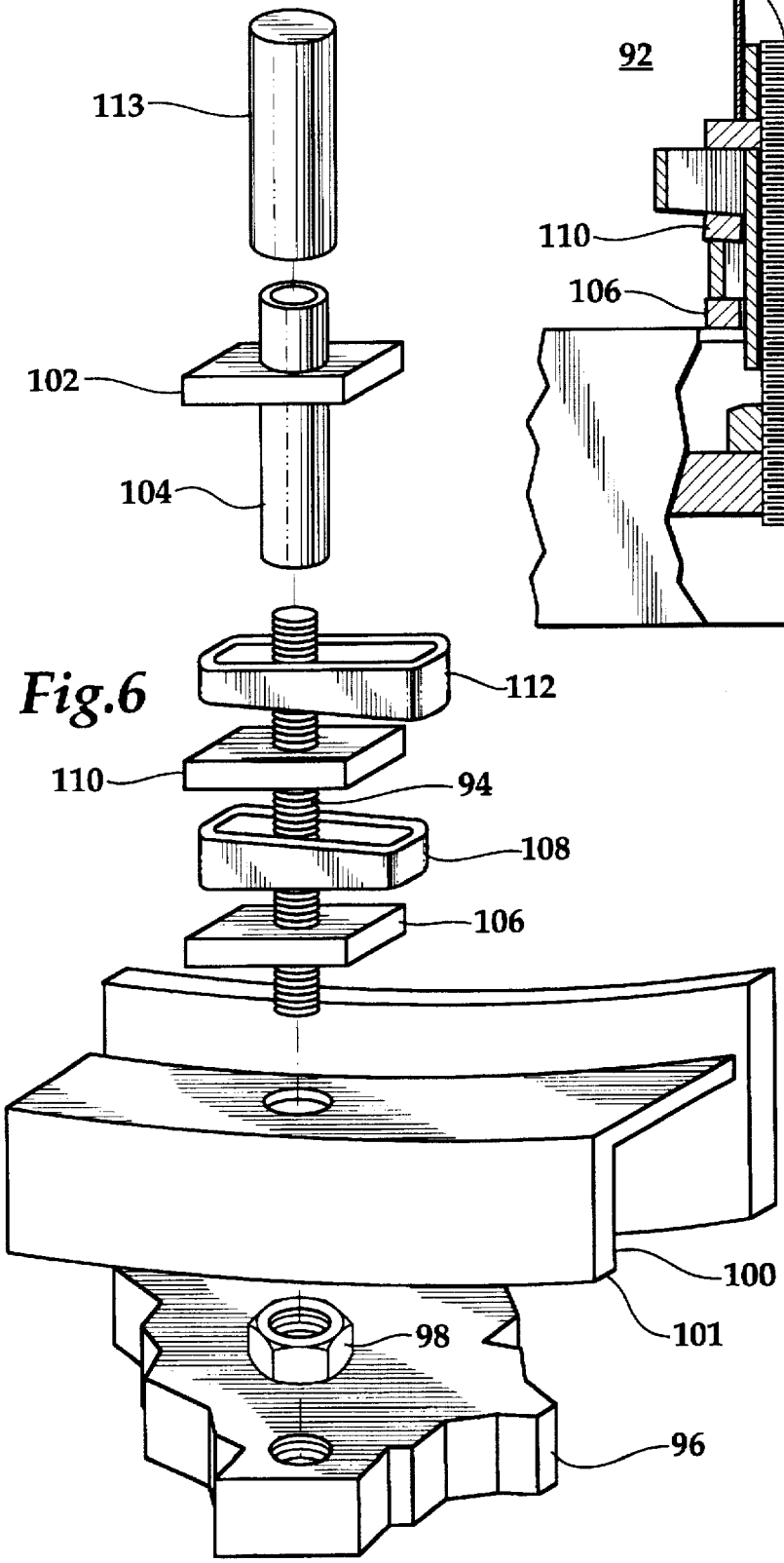
FIG. 6 is an exploded view of the device as used with a cone crusher apparatus.

A third slightly modified wedge tensioning device 92 is shown in FIGS. 5 and 6. A threaded shank member 94 is provided with one end threadably received into crusher bowl section 96. Crusher adjustment cap 100 has a flange member 101 which fits over the edge of crusher bowl 96. A jam nut 98 is threadably received over shank member 94 and is selectively tightened to secure shank member 94 to crusher bowl 96 to prevent shank member 94 from rotating loose from crusher bowl 96. Shank member 94 passes through an aperture in crusher adjustment cap 100. A retaining member 102 is provided and is threadably received onto shank member 94. Retaining member 102 is provided with a tubular sheath member 104 which is received over threaded shank member 94 to provide a covering and protect the threads of shank member 34. Optionally, a spacer 106 having an aperture there through may be received over shank 94 and positioned between crusher adjustment cap 100 and a wedge 108. A second spacer 110 with an aperture there through may be received over shank member 94 and positioned between wedge 108 and wedge 112. When one of said wedges is driven such that the coactive inclined surfaces of the wedge react against spacer 110 and retaining member 102, shank 94 is tensioned drawing crusher bowl 96 toward crusher adjustment cap 100. Tension is released by driving one of the wedge such that the inclined bearing surfaces allow the retaining member to move toward the crusher adjustment cap 100. A dust cap 113 is provided and may be received over retaining member 102 and over shank 94 to protect shank 94 from damage.

An improved device for securing and tensioning has been provided in which one of a pair of wedge members having apertures there through is selectively driven between a flange forming member providing a receiving surface and an apparatus member. Either wedge member may be rapidly and readily tensioned or released by driving it from its wedge position on the shank member to thereby relieve tension. Adjustments may be made rapidly in a simple manner without special tools yet permit the tensioning or release by selectively driving either wedge away from the shank member.

Various modes of carrying out the invention are contemplated as being within the scope of the following claims particularly pointing out and distinctively claiming the subject matter which is regarded as the invention.

What is claimed is:

1. A wedge tensioning device, in combination with a screening apparatus and screen for selectively tensioning the screen thereby, said device comprising:

an elongated member having a shank extending through aligned apertures in the screening apparatus;

a head on one end of said shank seated against the screening apparatus;

a nut member having a bearing surface;

means on said shank remote from said head for removably receiving said nut member with the bearing surface thereof facing the screening apparatus;

a first tapered wedge member having a pair of inclined bearing surfaces with said shank extending through an elongated aperture in said wedge member whereby one of said bearing surfaces of said first tapered wedge member is seated against said screening apparatus;

a spacer with an aperture and two parallel bearing surfaces, one surface of which is seated against the second bearing surface of said first tapered wedge member; and a second tapered wedge member having a pair of inclined bearing surfaces with said shank extending through an elongated aperture in said second wedge member whereby one of said bearing surfaces of said second tapered wedge member is seated against said nut member; and the second bearing surface of said second tapered wedge member is seated against the second bearing surface on said spacer whereby said shank is drawn outwardly from the screening apparatus by selectively applying tension to either the first or second wedge members.

2. A wedge tensioning device according to claim 1 wherein the nut member is threaded to be threadably received on said shank.

3. A wedge tensioning device in combination with a crusher adjustment cap and a cone crusher bowl for selectively tensioning the adjustment cap thereby, said device comprising:

an elongated member having a shank extending through an aperture in the crusher adjustment cap with one end of said shank attached to the cone crusher bowl;

means to attach one end of said shank to the crusher bowl;

a retaining member having a bearing surface;

means on said shank remote from the end of said shank attached to the crusher bowl for removably receiving said retaining member with the bearing surface thereof facing the crusher bowl;

a first spacer with an aperture and two parallel bearing surfaces, one surface of which is seated against the crusher adjustment cap;

a first wedge member tapered to provide a pair of inclined bearing surfaces with said shank extending through an elongated aperture through said bearing surfaces of said first wedge member whereby one of said bearing surfaces of said first wedge member is seated against the second bearing surface of said first spacer;

a second spacer with an aperture and two parallel bearing surfaces, one surface of which is seated against the second bearing surface of said first tapered wedge member; and a second wedge member tapered to provide a pair of inclined bearing surfaces with the shank extending through an elongated aperture through said bearing surfaces of said second wedge member whereby one of said bearing surfaces of said second wedge member is seated against said bearing surface of said retaining member and the second bearing surface of said second wedge member is seated against said second bearing surface of said second spacer to draw said shank outwardly from said crusher adjustment cap and thereby apply tension to the crusher bowl.

4. A wedge tensioning device according to claim 3 wherein the retaining member is threaded to be threadably received on said shank.

* * * * *